US006575808B1

(12) United States Patent
Wright et al.

(10) Patent No.: US 6,575,808 B1
(45) Date of Patent: Jun. 10, 2003

(54) POM-POM PUPPET AND METHOD OF CHEERING WITH POM-POM PUPPET

(76) Inventors: Alvina L. Wright, 4742 Liberty Rd S. #105, Salem, OR (US) 97302; Elana Burbank, 4742 Liberty Rd. S., #105, Salem, OR (US) 97302

( * ) Notice: Subject to any disclaimer, the term of this patent is extended or adjusted under 35 U.S.C. 154(b) by 0 days.

(21) Appl. No.: 09/896,641

(22) Filed: Jun. 29, 2001

(51) Int. Cl.[7] ..... A63H 13/02
(52) U.S. Cl. ..... 446/321; 446/327; 446/330
(58) Field of Search ..... 428/4; 446/330, 446/369, 372, 390, 320, 321, 327

(56) References Cited

U.S. PATENT DOCUMENTS

| | | | | | |
|---|---|---|---|---|---|
| 849,588 | A | | 4/1907 | West | |
| D155,130 | S | | 9/1949 | Des Forges et al. | |
| D169,026 | S | | 3/1953 | Barry | |
| 4,112,573 | A | * | 9/1978 | Moye | 140/71 R |
| 4,369,215 | A | | 1/1983 | Offen et al. | |
| 4,427,724 | A | * | 1/1984 | Stark et al. | 116/173 |
| 4,457,097 | A | | 7/1984 | Miller et al. | |
| D284,487 | S | | 7/1986 | Pratt | |
| 4,806,396 | A | | 2/1989 | Pratt et al. | |
| 5,234,725 | A | | 8/1993 | Smith | |
| 5,368,518 | A | * | 11/1994 | Hitchcock | 446/329 |
| D382,028 | S | | 8/1997 | Robbins | |
| 5,962,086 | A | | 10/1999 | Offen | |

* cited by examiner

*Primary Examiner*—Jacob K. Ackun
(74) *Attorney, Agent, or Firm*—Jensen & PunTigam, P.S.

(57) ABSTRACT

A puppet for cheering having manipulable limbs having pom-pom attachments limbs, and a method of using the same. The puppet may include a handle portion that can be held by the user during use of the puppet, on which is attached one or more limb assemblies, and each limb assembly may include an upper limb element pivotally attached to the body support, an extending limb element pivotally carried on the upper limb element, a pom-pom attached to the extending limb element, a means to activate the limb assemblies, and a head connected to the handle portion. The method includes use of the puppet as a method of cheering, such that by manipulation of the limbs the pom-poms attached to the limbs move and the puppet appears to be the one cheering.

9 Claims, 3 Drawing Sheets

POM-POM PUPPET AND METHOD OF CHEERING WITH POM-POM PUPPET

BACKGROUND OF THE INVENTION

1. Field of Invention

This invention relates to puppets and to cheering with pom-poms and more particularly to a puppet with pom-poms and to a method of cheering with a puppet with pom-poms.

2. Description of Prior Art

Pom-poms are bundles of strands ofa material such as plastic, textile or crepe paper. The prior art teaches that pom-poms are regularly used for cheering at and for competing entities, such as at professional, college and high school sporting team events. The pom-poms known and used include types that are hand-held, finger-held and pom-poms attached to the end of a stick. However, regardless of how the pom-poms are held, the pom-poms are manipulated by the user by movement of a finger, arm or stick, and are typically moved in multiple directions. The user is and appears to be the one manipulating the pom-poms.

Another common feature associated with cheering, particularly with the cheering of sports teams, is the adoption and use of a character or mascot for the team. A costumed person dressed as the character or mascot may show up at the event to cheer on the team, much to the amusement and happiness of the spectators watching. In addition, novelty representations of the character or mascot are known and these are sometimes brought to the events and held by fans and waved around in a cheering fashion.

It is also known to form puppets with heads representing characters of all varieties, including animal characters, whereby the limbs of the puppet are able to be manipulated by the fingers, hands or arms of the user, and whereby the limbs may include attachments such as a drum and stick or boxing gloves, whereby the puppet is manipulated to give the appearance of playing a drum or boxing.

While the prior art shows the construction and use of pom-poms for cheering, including cheering at cheering events, and the novelty representations of characters and mascots at events as well as puppets, the prior art does not show a puppet that includes pom-poms as attachments to the puppet; or the appearance of movement of the pom-poms by any other than the one physically holding the pom-poms; or the use of puppets with pom-pom attachments such that the pom-poms can be manipulated for cheering at an event, such as a sporting event.

For example, U.S. Pat. No. 5,962,086, to Offen, discloses a pompon pet. The pompon pet is used as a cheerleading device in the fashion of the typical use of pom-poms. That is, it is held in the user's hands and the user is and appears to be the one moving the pom-poms. Furthermore, the features that suggest that the pom-poms are a character, that is a pom-pom pet, such as the eyes, are hidden from the view of others as the device is moved around in typical pom-pom fashion. It is only when not is use that the pom-pom device looks like furry little creatures when placed on a surface.

Similarly, U.S. Pat. No. 5,234,725, to Smith, for a wrist pompon structure, U.S. Pat. No. 4,806,396, to Pratt et al., for a pompon prize device, and U.S. Pat. No. 4,369,215, to Offen et al., for a finger-held pompon are all used for cheering in the typical fashion. That is, when used and manipulated, the pom-poms give the appearance of being manipulated by the one doing the manipulation, and what is common is the pom-poms are meant to be directly manipulated by the user, with no suggestion that the user may act as an intermediary to a puppet or character so as to create a fiction.

In addition, while U.S. Pat. No. 849,588, to West, discloses a doll that includes arms and legs that are manipulable by fingers,.and the suggestion of the attachment of an "amusement device" to the arms of the doll, the only amusement devices suggested are a drum and a sounder. Pom-poms are not suggested and there are no suggestions for use of the doll as a cheering item or for use of the doll so as to create the perception that the doll is acting in a "real" sense, rather then merely as a toy item.

OBJECTS AND ADVANTAGES

As such, an object of the invention is to create an additional method of cheering for spectators at an event. Another object is to have a method of cheering that gives the appearance of a character or mascot as the mover of the pom-poms, rather than the manipulator of the pom-poms. Another object of the method is to add to the joy and excitement of cheering anywhere, including at events, and to add to the user's and spectator's feelings of allegiance to the team. Another object is to have a puppet that includes the addition of pom-poms on its limbs that can be manipulated. Another object is to create an additional use for a puppet as a cheering entity, such that it can be used in a "real" sense in the real world. Another object is to create a new way of using and moving pom-poms. Finally, another object is to create a way to move two pom-poms in one hand, rather then having to use two hands.

BRIEF SUMMARY OF THE INVENTION

The present invention includes a puppet having manipulable limb assemblies having pom-pom attachments to the limbs, and a method of using the same. In the preferred embodiment according to the invention, the puppet includes a handle portion that can be held by the user during use of the puppet, on which is attached one or more limb assemblies. Each limb assembly includes an upper limb element pivotally attached to the body support, an extending limb element pivotally carried on the upper limb element, a pom-pom attached to the extending limb element, a means to activate the limb assemblies, and a head connected to the handle portion. The means to activate include a triggering means and a return means, which is disposed so as to allow the user to grasp and carry the handle portion while at the same time controlling the activation means.

The method includes use of the puppet as a method of cheering, such that by manipulation of the limbs the pom-poms attached to the limb assemblies move and the puppet appears to be the one cheering.

DETAILED DESCRIPTION OF THE INVENTION

Figure 2:
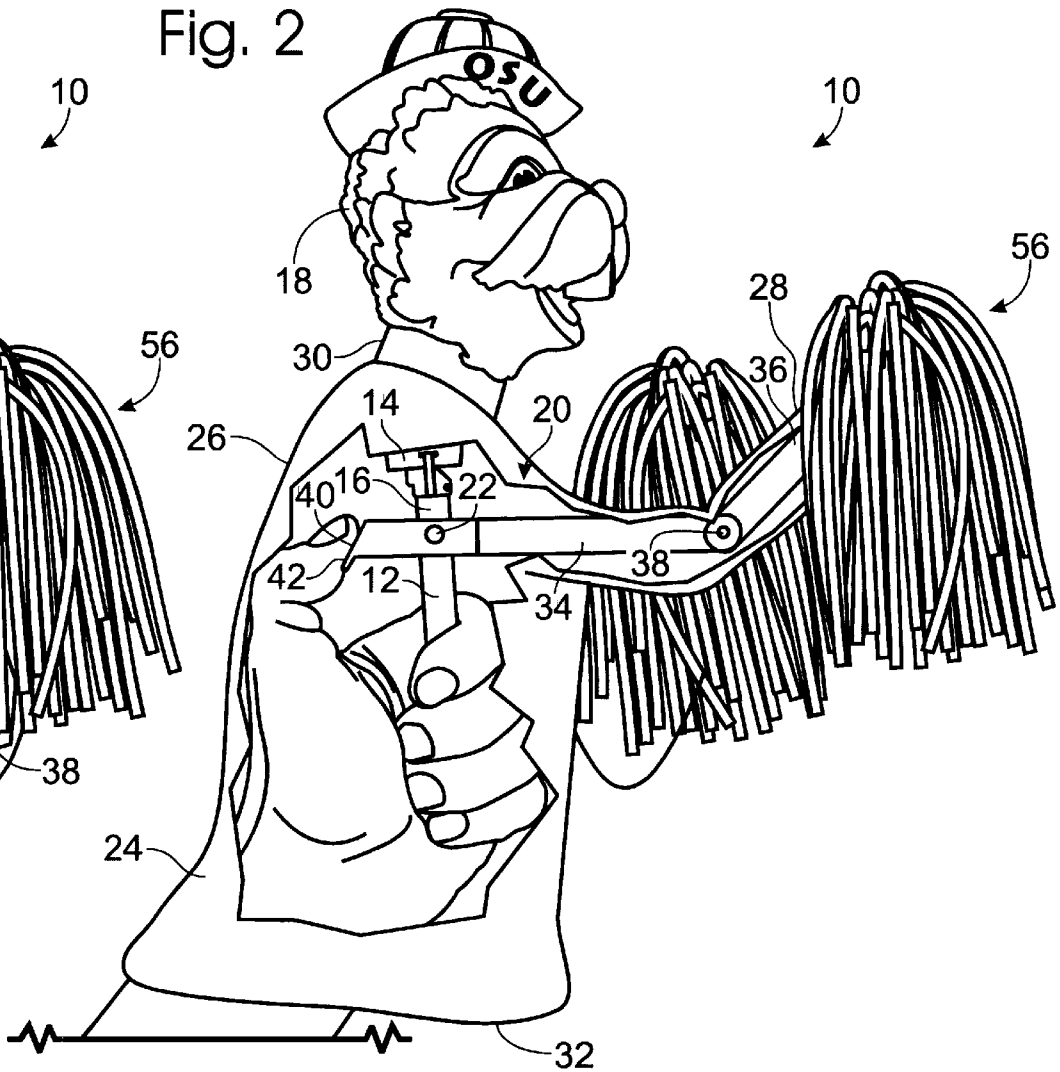
FIG. 2 is the puppet and view shown in FIG. 1 showing the puppet with a limb extended as in cheering.
Figure 1:
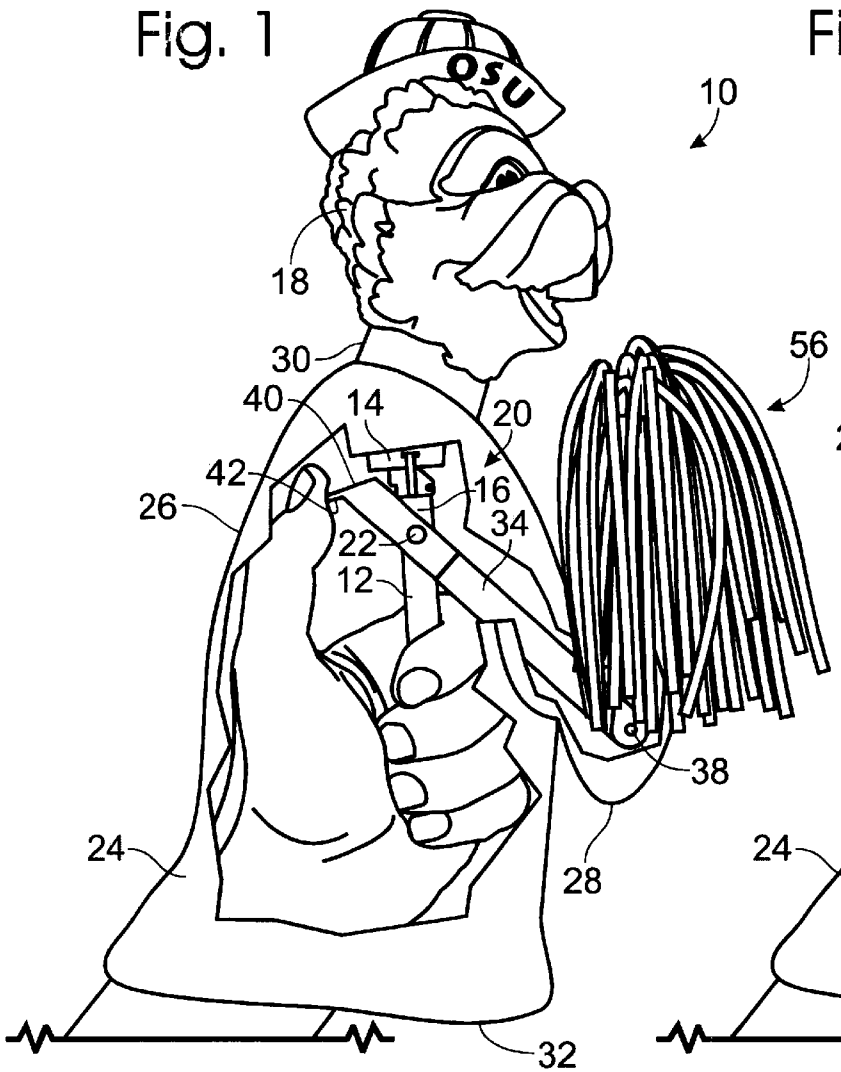
FIG. 1 is a side partial cut away view showing the preferred embodiment of the handle and limb assemblies and positioning of a user's hand in use with the puppet in the resting position.
Figure 3:
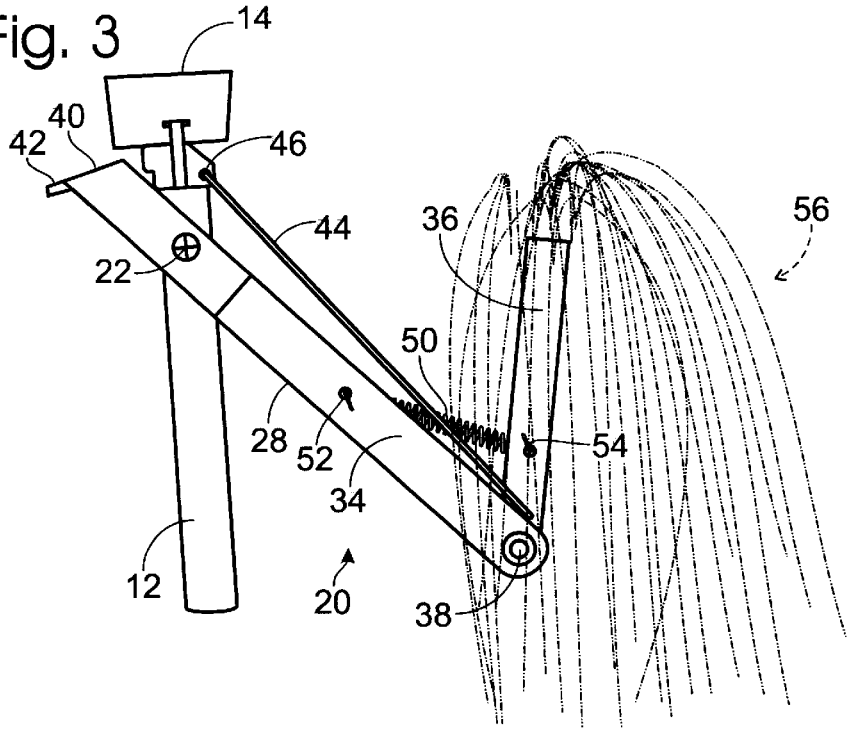
FIG. 3 is a partial side view of a limb assembly of the puppet shown in FIGS. 1 and 2 in the resting position.
Figure 4:
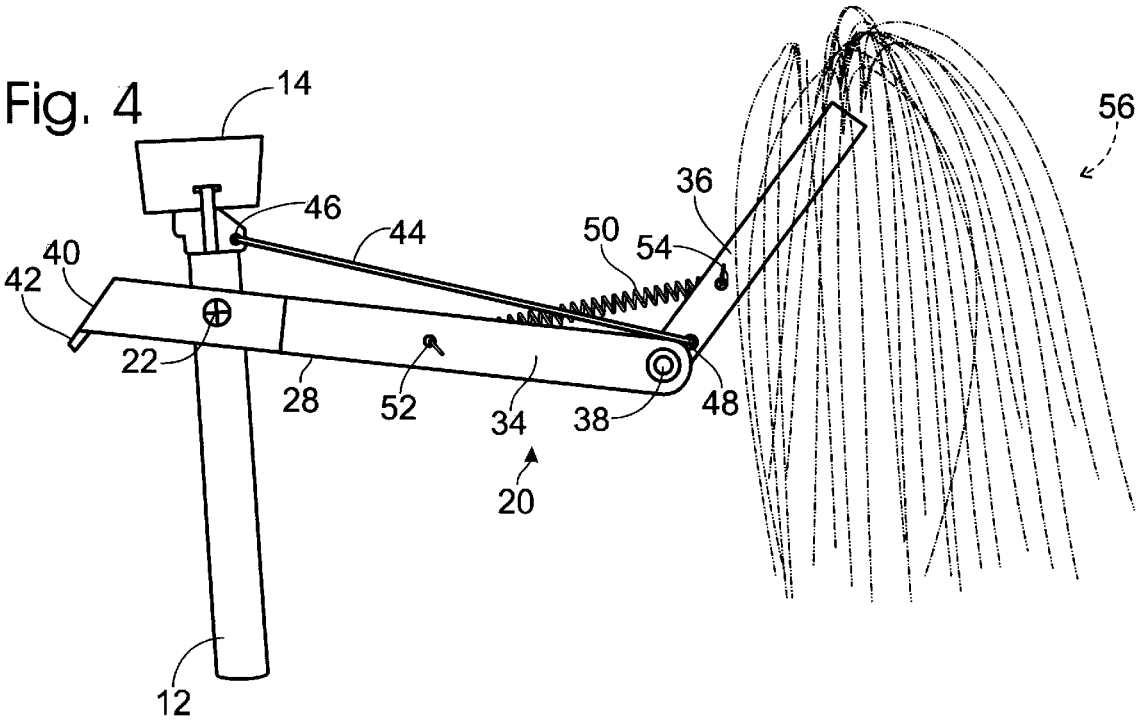
FIG. 4 is the view shown in FIG. 3 with the limb in the extended position as in cheering.
Figure 5:
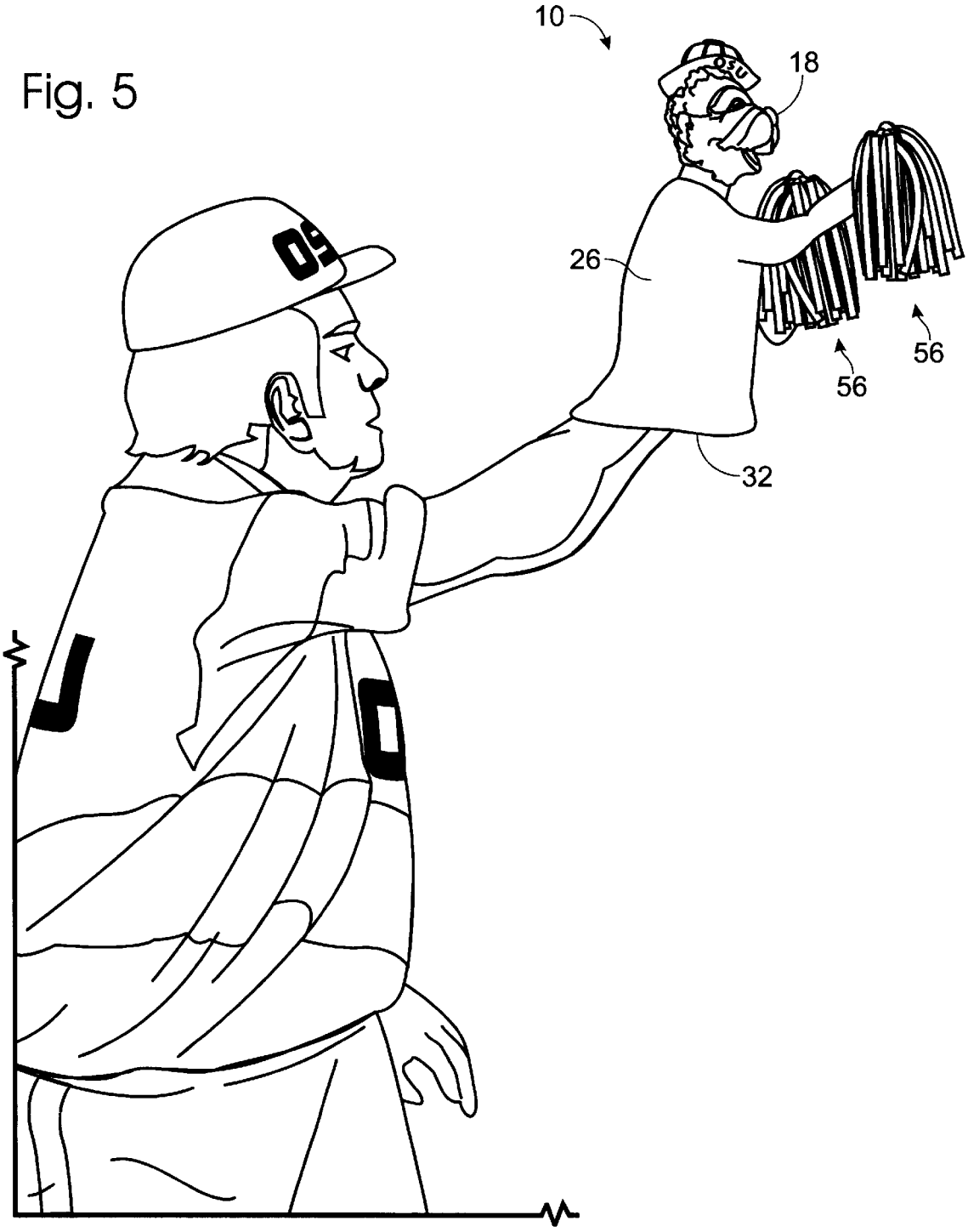
FIG. 5 is a perspective view showing a puppet in use.

Shown in FIGS. 1–5 is the preferred embodiment of a puppet 10 designed in accordance with the present invention. The puppet 10 includes a handle for grasping by a hand 12 attached to a head support portion 14 on an upper end of the handle 16, a head 18 resiliently connected to the head support portion 14, manipulable limb assemblies 20 attached to the handle 12 at a pivot area 22, one on each side of the handle 12 and acting as mirror images to each other, and an outfit 24 that covers the handle 12, head support portion 14 and limb assemblies 20.

The head 18 contains an internal cavity in which a spring 50 is attached which encircles an upper end of head support portion 14, thereby connecting the head 18 to the handle 12. The outfit 24 includes a loose body 26, arms 28 that cover the limb assemblies 20, a neck 30 portion and an open bottom 32 to allow insertion of the hand of the user. Shown is a beaver caricature, but any caricature or figure will suffice as will any style of outfit.

Each limb assembly 20 includes an upper limb element 34 which is connected to the handle 12 at the pivot area 22 and an extending limb element 36 connected pivotally to the upper limb element 34 which operates as an elbow pivot 38. The majority of the upper limb element 34 extends forward from the handle 12 at a downward angle when in the at rest position, while in the rest position the upper limb element 34 projects generally upward from the upper limb element 34.

Rearward of the pivot area 22 is a lever 40 bent over to form a tab 42 for the user's thumb or finger.

Pivotally connected to the head support portion 14 is an actuating rod 44 which is connected to the head support portion 14 via a hole in the head support portion 14 at one end and pivotally connected to rod connecting aperture 48 in extending limb element 36.

It spring 50 is connected to the upper limb element 34, through an upper limb element spring aperture 52 at its one end and to the extending limb element 36 through extending limb element spring aperture 54 in at its other end.

Attached to the free end of each extending limb element 36 is a pom-pom 56.

The puppet 10 is held by a user's hand that grasps the handle 12. This same hand also operates the manipulable limb assemblies 20. The thumb or a finger of the hand may be used and the digit presses on the tab 42 of the lever 40. When operated, the limb assemblies 20 move from the at rest positions shown in FIGS. 1 and 3, to the extended positions shown in FIGS. 2 and 4. This movement is similar to the movement seen by cheerleaders. While shown being manually operated, any means, including motor means, may be employed to power the limbs.

The method includes use of the puppet 10 as a method of cheering at any event, such that by manipulation of the limbs the pom-poms 56 attached to the limbs move and the puppet 10 appears to be cheering.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A puppet for cheering, comprising:

a handle;

a head connected to the handle; and one or more manipulable limbs carried by the handle, wherein said manipulable limbs comprise a limb assembly, said assembly comprising an upper limb element pivotally connected to the body portion, an extending limb element pivotally carried on the upper limb element having a pom-pom attachment, an activation means for activating the upper limb element and the extending limb elements, said activation means including a trigger means, said trigger means disposed so as to allow the user to carry the body portion in one hand while at the same time controlling the activation means with the same hand.

2. A puppet as in claim 1, wherein said head portion depicts an animal figure.

3. A puppet as in claim 1, wherein said head portion depicts a team mascot.

4. A puppet as in claim 1, wherein said head portion depicts any figures.

5. A puppet as in claim 1, wherein said activation means includes a motor.

6. A method of cheering, comprising the steps of:

providing a puppet having a body portion, a head connected to the body portion, and two manipulable limbs carried by the body portion on opposite sides thereof, said limbs each having a pom-pom attached for movement by a user of the puppet; and manipulating the limbs in such a manner as to cause the limbs and pom-poms to move, emulating a cheeleading action.

7. A method of cheering as in claim 6, wherein said head on said puppet provided depicts an animal figure.

8. A method of claim 6, wherein said head on such puppet depicts a team mascot.

9. A method of cheering as in claim 6, wherein said head portion depicts any figure.

* * * * *